United States Patent [19]

Korzon

[11] 4,091,555

[45] May 30, 1978

[54] KNOCKDOWN SELF-SUPPORTING PICTURE FRAME DEVICE

[75] Inventor: Edward S. Korzon, Beacon Falls, Conn.

[73] Assignee: Dura Plastics of New York, Inc., Westport, Conn.

[21] Appl. No.: 753,197

[22] Filed: Dec. 22, 1976

[51] Int. Cl.[2] ..... G09F 1/12

[52] U.S. Cl. ..... 40/152.1; 40/155; 248/469

[58] Field of Search ..... 40/152, 156, 155; 248/469

[56] References Cited

U.S. PATENT DOCUMENTS

| | | | |
|---|---|---|---|
| 2,661,560 | 12/1953 | Malby | 248/469 X |
| 2,758,402 | 8/1956 | Fulmer | 40/152.1 |
| 2,796,689 | 6/1957 | Yannone | 40/155 X |
| 3,707,053 | 12/1972 | Itano | 40/158 R |
| 3,973,343 | 8/1976 | Tolfsen | 40/152.1 |

*Primary Examiner*—Louis G. Mancene

*Assistant Examiner*—Wenceslao J. Contreras

*Attorney, Agent, or Firm*—Birch, Stewart, Kolasch & Birch

[57] ABSTRACT

A picture frame device for holding and displaying pictures and the like is provided which consists of a front and back sheet of clear acrylic plastic having holes drilled therethrough in registry in each of the corners thereof to receive the ends of the two bent rods which extend through the corner holes to anchor the front and rear plastic sheets together so that a picture or the like may be sandwiched therebetween. The rods are bowed in a horseshoe or wicket configuration in top plan and side elevation and resemble half an arch in end view such that the arcuate portions of the two rods tend to engage centrally of the rear of the frame device. A sleeve of clear plastic or the like retains the central portions of the two rods in juxtaposition at the central position over the rear surface of the frame to provide a four-legged, two-positioned stand for holding the frame upright at two different angles on a surface such as a table top.

8 Claims, 6 Drawing Figures

KNOCKDOWN SELF-SUPPORTING PICTURE FRAME DEVICE

FIELD OF THE INVENTION

This invention relates to display devices and most particularly to a knockdown picture frame or display device constructed of knockdown components which provide a self-supporting frame capable of different angles of repose on a surface on which it is resting.

BACKGROUND OF THE INVENTION

It is most desirable to have readily assemblable framing devices for displaying favorite photographs, prints and other two-dimensional art objects which is neither expensive nor complicated to assemble and use while at the same time displaying the art object of its best advantage.

In the past, picture frames have by definition been relatively cumbersome utilizing corner clips, channels, cardboard backings, mats and glass fronts and the like with fold out tabs and other cumbersome appendages utilized in the backing sheets or on the frame channels for the purpose of rendering the frame free standing on a surface such as a table top upon which the frame has been placed. Furthermore, certain pictures are better shown at different angles of display and most frames which are available in the prior art have but one angle at which they may be set upon a surface.

Accordingly, it is an object of the present invention to provide a new and novel knockdown self-standing picture frame and display device.

It is another object of the present invention to provide a new and novel knockdown free standing picture frame and display device which is constructed entirely of plastic components.

Yet another object of the present invention is to provide a new and novel picture frame and display device of the knockdown self-standing type which is assemblable without fasteners by means of the very component of the stand upon which the frame rests and which is held together purely by the friction of the interrelated parts.

Yet another object of the present invention is to provide a new and novel picture frame and display device of the knockdown self-standing type which can be readily manufactured in various sizes and in a wide variety of shapes.

These and other objects of the present invention will become more fully apparent with reference to the following specification and drawings which relate to a preferred embodiment of the present invention.

SUMMARY OF THE INVENTION

The picture frame and display device of the present invention comprises a clear acrylic obverse plate which is relatively thick compared to a clear acrylic backing plate between which a picture, tapestry or other two dimensional art object is positioned. In a preferred embodiment, the corners of the respective obverse and backing plates each bear drilled ports or openings which are in registry between the two plates and which are adapted to receive the ends of rod means which fit into the holes in the plates to retain the plates in juxtaposition one with the other on the rod means and provide the stand structure for the frame device.

The rod means are each in the form of a wicket (a garden wicket shape) which has been bent away from the vertical into an arcuate half arc formation in the plane of the wicket leaving straight dependent leg sections and a compound curved arch extending outwardly from the back of the backing plate of the frame. A similar mirror image wicket-shaped rod structure is positioned back to back with the first wicket-shaped rod structure and the two structures are juxtaposed at their mutual apices where they are held in juxtaposed relationship by a short length of plastic sleeve or the like, namely, a short tube through which both the wickets or rods have been extended. Then, when each of the wicket shaped rods has its ends placed in the holes along one side of the backing plate and thus extended into the holes in the obverse plate of the frame, the other rod has its straight leg sections forced into the pair of holes remaining in the backing and obverse plates of the frame. This flexes the rods slightly creating friction in the holes in the plates and therefore causes the rod tips to retain the plates in juxtaposition and on the rod tips. The flexing action of the rods causes the rods to react with the short tubular sleeve around the mid-section thereof to provide aa rigid stand extending outwardly from the back of the backing plate of the frame. Because of the compound arcuate curvatures of the two wicket shaped rods, the frame may be tilted backward from each of two 90° positions such that the display angle between the surface on which the frame is resting and the obverse face of the abverse plate of the frame is selectable by rotating the frame at 90°. This causes the curved rods to engage the table top or surface at different portions thereof. The compound bend in each of these different portions, namely two different positions, results in a different display angle on the surface for the frame.

DETAILED DESCRIPTION OF THE DRAWINGS

Referring in detail to the drawings and with particular reference to FIGS. 1, 2, 3 and 6, the frame 10 of the present invention is shown as including a relatively thick clear obverse plate 12 of clear acrylic resin or other similar and suitable material which is overlying a picture or other art work illustration P. The illustration P, in turn, is retained in juxtaposition with the rear surface of the obverse plate 12 by means of a back plate 14 which is coterminous with the plate 12 and which is preferably made of the same clear acrylic or other suitable material as the plate 12.

In each of the four corners of the rectangular plate 12 and 14 there are formed or drilled holes 12H and 14H which are in respective registry between the two plates which extend normal to the obverse surface of the plate 12 and which extend completely through both of the said plates.

The frame 10 is provided with a two positioned multi-angled stand means which is comprised of first and second wicket shaped rod members R1 and R2 having their ends R1A, R1B and R2A, R2B inserted through the registered holes 12H, 14H at each of the four corners of the obverse and back plate members 12 and 14 to thereby secure the plate portions of the frame 10 securely together.

Figure 1:
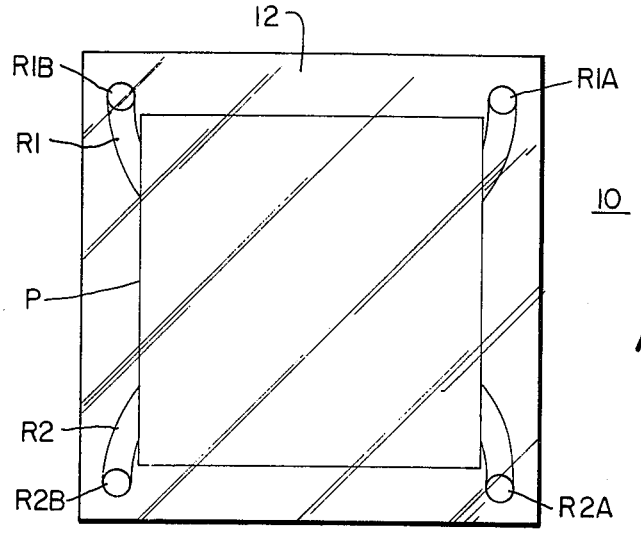
FIG. 1 is a front plan view of the frame of the present invention.
Figure 2:
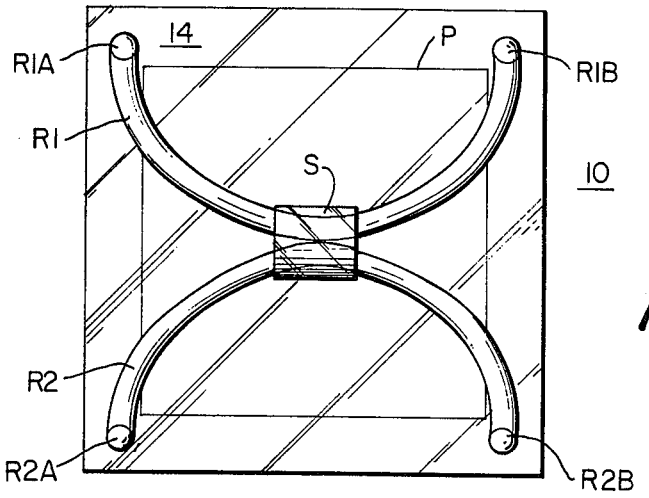
FIG. 2 is a rear plan view of the frame of the present invention.
Figure 3:
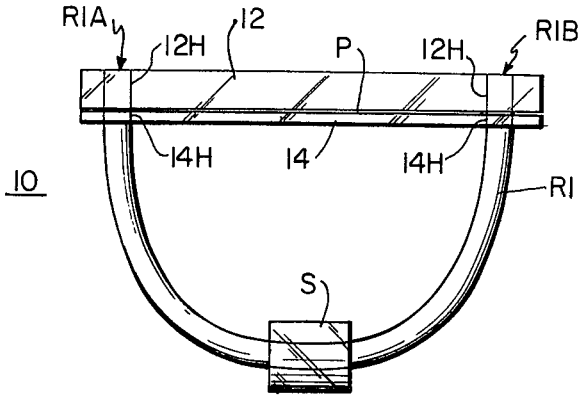
FIG. 3 is a top plan view of the frame of the present invention.

As shown in top plan view in FIG. 3, the rod member R1 is basically U-shaped and is curved with the exception of the straight portions which are thrust through the holes 12H and 14H in the plates 12 and 14, respectively, to maintain the frame in assembled condition. As also illustrated in FIG. 4, there is an arched shaped curvature in a direction inwardly of the backing plate 14 of the rod members R1 and R2 as illustrated clearly in FIGS. 1, 2, 4 and 5 pass through a plastic sleeve S (which is also made of clear acrylic in a preferred embodiment of the present invention) such that the apices of the arcuate portions of the rod members R1 and R2 are juxtaposed within the sleeve S to rigidify the frame stand structure constituted by the rod members R1, R2 and the sleeve S.

Figure 4:
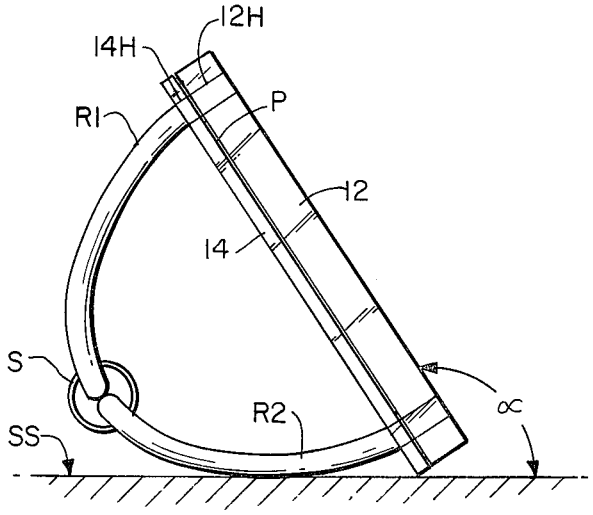
FIG. 4 is a side elevation of the frame of the present invention sitting on a surface and illustrating a first display angle of the frame on that surface.

As illustrated in FIG. 4, a first angle $\alpha$ of display between the obverse face of the obverse plate 12 and a supporting surface SS is achieved by tilting the frame backwards onto the relatively straight portions of the rod member R2 or R1 as the case may be with the sleeve S having its longitudinal central axis horizontally disposed, i.e. parallel to the supporting surface SS.

Figure 5:
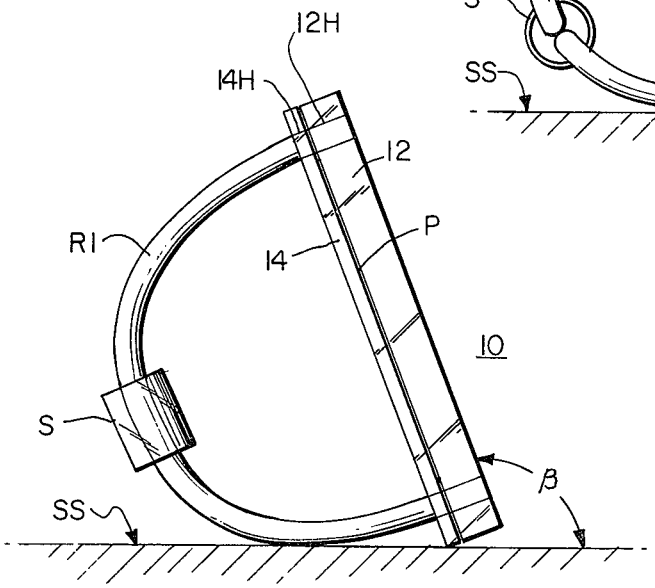
FIG. 5 is a side elevation similar to FIG. 4 but rotated 90° to illustrate a second display angle achieved by the present invention on a surface.
Figure 6:
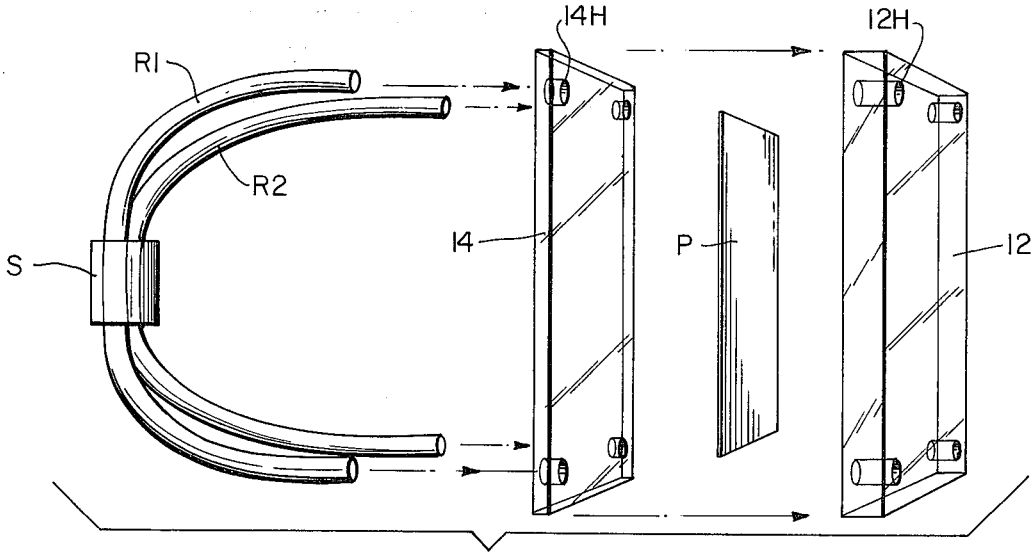
FIG. 6 is an exploded view illustrating the five components and art object to be displayed of the present invention.

In order to provide a steeper (smaller) display angle $\beta$ as shown in FIG. 5, the entire frame 10 is rotated 90° such that the longitudinal axis of the sleeve S is substantially vertically disposed, i.e. substantially normal to the supporting surface SS such that the configuration of the bend in one side of each of the rod members R1 and R2 has a shallower curvature at that point resulting in the smaller display angle $\beta$.

In order to change the picture or other art object P, one need merely pull out the tips R1A, R1B, R2A and R2B of the rod members R1 and R2 separate the obverse and backing plates 12 and 14, respectively, and remove the picture or display P from between them. Then another art object or picture P is placed between the obverse plate 12 and the backing plate 14 which the illustration facing toward the obverse face of the plate 12 and the holes 14H and 12H are re-aligned in registry one with the other and the tips R1A, R1B, R2A and R2B of the rod members R1 and R2 are reinserted into the holes. In the process of replacing the object to be displayed, the desired display angle should be determined and the rods R1 and R2 and the retaining sleeve S oriented with respect to the picture such that this display angle is attained.

As can be seen from the foregoing specification and drawings, this invention provides a new and novel picture frame device which, is both knockdown and self-supporting and which is constructed of a minimum number of parts in a fool proof manner such that the display angle of the contents may be readily adjusted from between one position and another and the contents of the frame may be readily changed.

It should be understood that the picture frame device of the present invention may be modified as would occur to one of ordinary skill in the art without departing from the spirit and scope of the present invention.

It is claimed:

1. A free standing display frame device comprising:
an obverse viewing plate;
a backing plate substantially coterminous with said viewing plate for sandwiching an art object therebetween;
a plurality of assembly ports defined in said plates and extending in registry therethrough; and
a plurality of rod means frictionally mounted in said assembly ports and through both of said plates to maintain said plates and said art object in a sandwiched configuration;
said rod means extending rearwardly of said backing plate to provide a stand configuration for said display device;
said rod means being distorted to a common position rearwardly of said backing plate to enhance the frictional mounting thereof in said assembly ports and maintain the assembled condition of said viewing plate and said backing plate with said rod means; and
retaining means at said common position maintaining said distorted condition of said rod means.

2. The invention defined in claim 1, wherein said rod means comprise substantially U-shaped wickets having the ends thereof inserted in selected ones of said assembly ports.

3. The invention defined in claim 1, wherein said assembly ports are disposed peripherally of said plates;
wherein said plates are engageable with a support surface at one edge thereof;
wherein said rod means comprise substantially U-shaped wickets having the ends thereof inserted in selected ones of said assembly ports; and
wherein said wickets are distorted toward the centermost portion of said backing plate to contact said support surface and constrain a predetermined display angle between said obverse plate and said support surface.

4. A free standing display frame device comprising:
an obverse viewing plate;
a backing plate substantially coterminous with said viewing plate for sandwiching an object therebetween;
a plurality of assembly ports defined in said plates and extending in registry therethrough; and
a plurality of rod means frictionally mounted in said assembly ports and through both of said plates to maintain said plates and said art object in a sandwiched configuration;
said rod means extending rearwardly of said backing plate to provide a stand configuration for said display device;
wherein said assembly ports define the corners of a rectangle;
wherein said rod means comprise first and second wicket shaped rods having their respective ends inserted in assembly ports defining opposing sides of said rectangle;
wherein said wicket means are curved inwardly from their ends to define first and second adjacent apices; and
wherein said frame device further includes a sleeve member encompassing said wicket shaped rods about said adjacent apices to secure said rods in said stand configuration.

5. The invention defined in claim 4, wherein said sleeve member has a longitudinal axis;

wherein said frame device is engageable with a support surface at one edge of said plate means and by at least one of said rod means; and wherein said obverse viewing plate defines first and second viewing angles with a said support surface as a function of the vertical and horizontal orientation of said longitudinal axis of said sleeve member with reference to said support surface.

6. A free standing picture display frame for resting on a supporting surface comprising:

a clear plastic obverse viewing plate of rectangular configuration;

a clear plastic backing plate coterminous with said viewing plate;

assembly ports defined through both said plates at the corners thereof;

first and second U-shaped wicket rods of clear plastic material each having a pair of ends frictionally inserted in a pair of assembly ports on respectively opposing sides of said rectangular plates;

said wicket rods extending inwardly from said backing plate and being bent in substantially symmetrical arches from said ends to a central position with reference to said backing plate; and a clear plastic sleeve enveloping said wicket rods and maintaining them substantially juxtaposed at said central position.

7. The display frame of claim 6, including a picture sandwiched between said obverse viewing plate and said backing plate.

8. A free standing display frame device comprising:

an obverse viewing plate;

a backing plate substantially coterminous with said viewing plate for sandwiching an art object therebetween;

a plurality of assembly ports defined in said plates and extending in registry therethrough; and a plurality of rod means frictionally mounted in said assembly ports and through both of said plates to maintain said plates and said art object in a sandwiched configuration;

said rod means extending rearwardly of said backing plate to provide a stand configuration for said display device;

wherein said assembly ports define the corners of a rectangle;

wherein said rod means comprise first and second wicket shaped rods having their respective ends inserted in assembly ports defining opposing sides of said rectangle;

wherein said wicket means are curved inwardly from their ends to define first and second adjacent apices; and wherein said frame device further includes a retaining member encompassing said wicket shaped rods about said adjacent apices to secure said rods in said stand configuration.

* * * * *